United States Patent [19]

Cohen

[11] Patent Number: 4,875,237

[45] Date of Patent: Oct. 24, 1989

[54] JACKET FOR DISPLAYING INFORMATION

[76] Inventor: Stephen Cohen, 1532 15th Ave. W., Seattle, Wash. 98119

[21] Appl. No.: 200,434

[22] Filed: May 31, 1988

[51] Int. Cl.[4] ..... A41D 1/02

[52] U.S. Cl. ..... 2/94; 2/115; 2/246; 2/102; 2/247; 40/586

[58] Field of Search ..... 2/94, 246, 1, 102, 115, 2/247, 249; 40/586

[56] References Cited

U.S. PATENT DOCUMENTS

| | | | |
|---|---|---|---|
| 2,647,261 | 8/1953 | Rassner | 2/1 |
| 3,381,307 | 5/1968 | Shingler | 2/94 |
| 4,266,297 | 5/1981 | Atkins | 2/94 X |
| 4,302,847 | 12/1981 | Miles | 2/94 X |
| 4,513,454 | 4/1985 | Anderson et al. | 2/246 |
| 4,627,110 | 12/1986 | Tengs | 2/115 X |
| 4,710,981 | 12/1987 | Sanchez | 2/115 |

*Primary Examiner*—H. Hampton Hunter

*Attorney, Agent, or Firm*—David L. Garrison; Patrick M. Dwyer; Robert M. Bellomy

[57] ABSTRACT

A jacket comprising a pair of front panels, a back panel, a collar and sleeves. The outer surface of the jacket having vent panels attached to front and rear panels which create accessible, upwardly extending vent panel pockets. Inside each vent panel pocket is a detachable flexible informational display panel which can be stored inside each pocket and hidden from view. When the situation arises, the flexible informational display panel can be repositioned and extended downwardly below the vent panel pocket and used to display information.

3 Claims, 4 Drawing Sheets

JACKET FOR DISPLAYING INFORMATION

TECHNICAL FIELD

This invention relates to articles of outer clothing such as jackets, vests, coats and the like. More particularly, this invention relates to outer clothing having informational display panels which can quickly and conveniently be selectively displayed.

BACKGROUND ART

There are various ways to communicate information on the visible, exterior surfaces of outer clothing such as jackets, coats, vests and the like. The form and content of the communication, of course, can vary greatly. The words or symbols themselves may be attached either permanently or temporarily to the garment's exterior surface. A common example of this is a baseball jacket with words or symbols printed or embroidered on its front or rear panels. Alternatively, the words or symbols may be attached to a secondary structure, such as a panel or sign, which itself may be attached to the garment's outer surface. An example of this is the number sign used by track meet contestants. There are however drawbacks to these methods which this invention addresses.

A drawback of having the information attached permanently to the exterior surface of the garment is that the garment loses its versatility. Garments having permanent information attached to the front or rear panels designed for a particular audience or purpose may not be appropriate in all situations in which the individual may want to wear the jacket. A police jacket, for instance, having the words "Police" or "Police Department" printed on its front or rear panels would not be appropriate for an undercover policeman.

The drawbacks of having the information temporarily attached to the exterior surface are; (1) the informational panel or sign must be physically attached or detached from the garment's surface; and (2) when detached, the informational panel or sign must be stored in a nearby location for future use. Both of these drawbacks make the use of temporarily attachable information display panels time consuming and inconvenient.

There is a need for articles of outer clothing such as jackets, coats, vests and the like having a quick and convenient means of selectively displaying information. Such a means is provided in the following invention.

DISCLOSURE OF INVENTION

It is the general object of the present invention to provide a outer garment which can quickly and conveniently stow and selectively display informational display panels.

The present invention provides for a conventional appearing jacket having front and rear panels, sleeves, collars, waistband and pockets having accessible vent pockets which can stow and selectively display informational display panels.

The jacket has two front panels and one rear panel. Each panel consists of an upper and lower portion attached at a seam. The upper portion of one or more of the panels is overlaid by a vent panel attached to the shoulder and collar which extends downward covering the upper panel and panel seam. The lower edge of each vent panel is attached to the underlying panel just below the panel seam by a suitable fastener creating an accessible, upward-extending vent pocket.

An informational display panel is attached to the jacket for selectively displaying information. One edge of the informational display panel is attached to the panel seam and may be extended downwardly beyond the vent pocket displaying the information printed or embroidered on its surface. When the wearer wants to discontinue the communication, the informational display panel is folded upward and extended into the vent pocket. Suitable fasteners, such as hook and loop connectors, are located inside each vent pocket and hold the upwardly extending edge of the informational display panel inside the vent pocket. When the informational display panel is positioned within the pocket, it is concealed from view. The vent pocket is closed by a fastener such as a hook and loop connector located on the lower edge of the vent panel.

To display the information, the vent pocket is opened by disconnecting the vent panel hook and loop connectors. The informational display panel is then disconnected from its hook and loop connectors located inside the vent pocket and extended downward through the vent panel pocket.

The invention herein disclosed, thus provides for a jacket which can quickly and conveniently stow and selectively display information.

BEST MODE FOR CARRYING OUT THE INVENTION

Referring specifically to the drawings, wherein like numerals indicate like parts, there is seen a jacket structure having a pair of front panels, 10 and 40, a rear panel 16, a pair of sleeves 3 and 5, a slide fastener 7 and a slide fastener pull 8.

Figure 1:
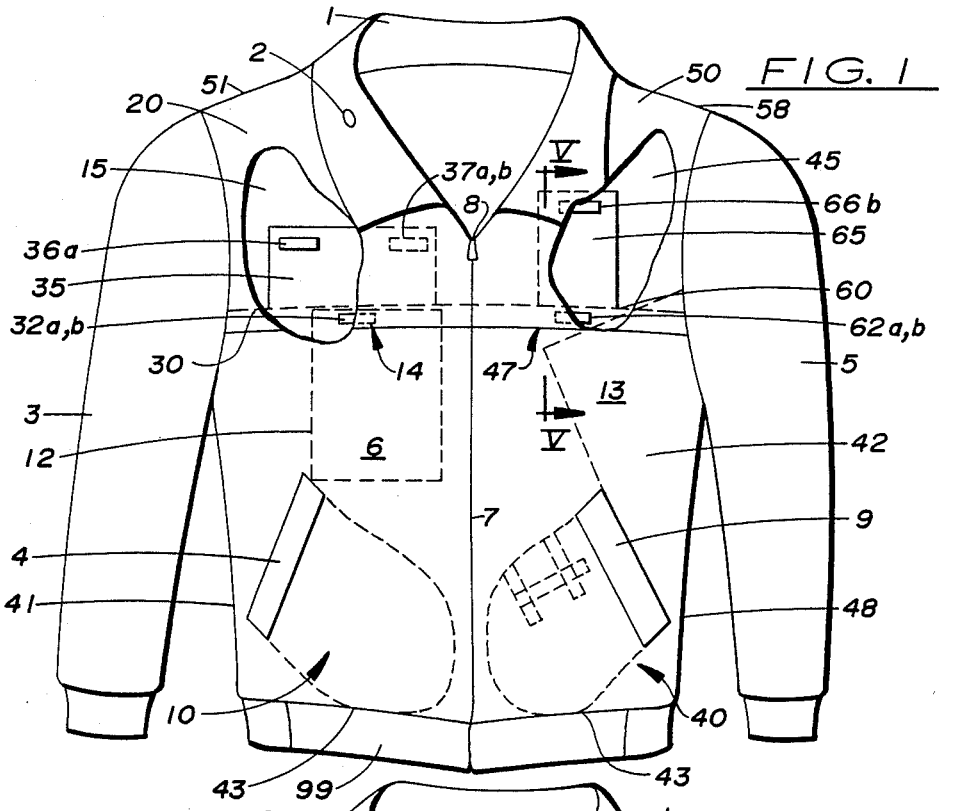
FIG. 1 is a front view of jacket with a portion broken away with front informational display panels extended upwardly inside front vent pockets and concealing information.
Figure 4:
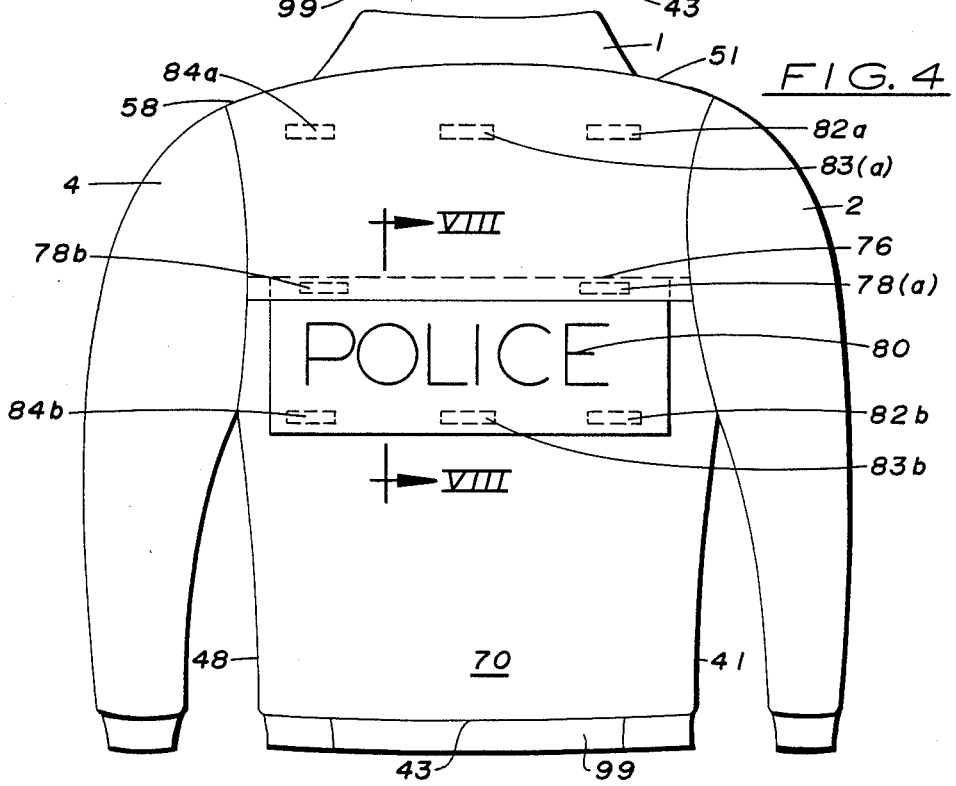
FIG. 4 is a rear view of jacket with informational display panel extended downwardly from rear vent pocket displaying information.

As shown in FIG. 1, the right front panel 10 interconnects with the rear panel 16, shown in FIG. 4, at the shoulder seam 51 and side seam 41. The right front panel 10 interconnects with the right sleeve 3 and the slide fastener 7 and extends downwardly to interconnect with waistband 99 along seam 43. The right front panel 10 consists of two parts; a lower right front panel 12 attached to a upper right front panel 15 at right front panel seam 30. The right front panel seam 30 extends horizontally across the right front panel 10 from a point just above the armpit of the right sleeve 3 to slide fastener 7.

As shown in FIG. 1, the left front panel 40 interconnects with the rear panel 16, shown in FIG. 4, at the shoulder seam 58 and side seam 48. The left front panel 40 interconnects with the left sleeve 5 and the slide fastener 7 and extends downwardly to interconnect with waistband 99 along seam 43. The left front panel 40 consists of two parts; a lower left front panel 42 attached to an upper left front panel 45 at left front panel seam 60. The left front panel seam 60 extends horizontally across the left front panel 40 from a point just above the armpit of the left sleeve 5 to slide fastener 7.

As shown in FIG. 1, the right front vent panel 20 overlays the upper right front panel 15. The upper edge of right front vent panel 20 is attached to the right shoulder seam and extends downward covering the upper right front panel 15 and right front panel seam 30. The lower edge of right front vent panel 20 extends approximately horizontally from the armpit of right sleeve 3 to the slide fastener 7. The left edge of right front vent panel 20 attaches to collar 1 and to slide fastener 7 with the right edge of right front panel 20 attaching to right sleeve 3. Attaching the right front vent panel 20 in the above stated fashion creates an accessible, upwardly extending right front vent pocket 14 as shown in the broken away portion of right front vent panel 10 in FIG. 1. As shown in FIG. 1, hook and loop connectors 32A and 32B open and close right vent pocket 14. Hook connector 32B is located medially on lower right front panel 12 just below right front panel seam 30. Loop connector 32A is located on inside surface of right vent panel 20 across from hook connector 32B.

Figure 5:
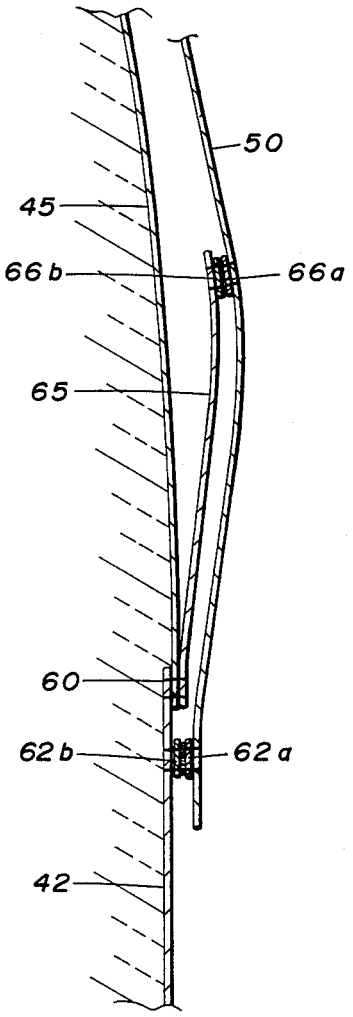
FIG. 5 is a cross-sectional view of the jacket shown in FIG. 1 taken along line 1—1 thereof.

As shown in FIG. 1, the left front vent panel 50 overlays the upper left front panel 45. The upper edge of left front vent panel 50 is attached to the left shoulder seam and extends downwardly covering the upper left front panel 45 and left front panel seam 60. The lower edge of left front vent panel 50 extends approximately horizontally from the armpit of left sleeve 5 to the slide fastener 7. The right edge of left front vent panel 50 attaches to collar 1 and to the slide fastener 7 with left edge of left front panel 50 attaching to left sleeve 5. Attaching the left front vent panel 50 in the above stated fashion creates an accessible, upwardly extending left front vent pocket 45 as shown in the broken away portion of the left vent panel 40 in FIG. 1. As shown in FIG. 5, hook and loop connector 62A and B open and close left vent pocket 47. Hook connector 62B is located medially on lower left front panel 42, just below left front panel seam 60. Loop connector 62A is located on the inside surface of left vent panel across from hook connector 62B.

Figure 2:
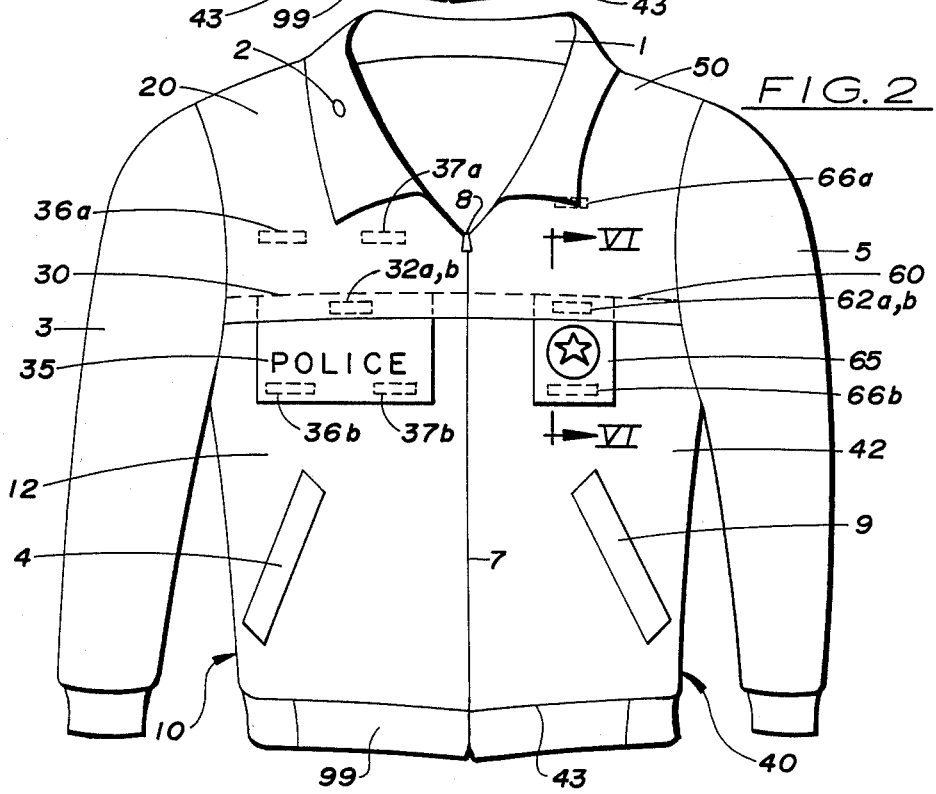
FIG. 2 is a front view of jacket with informational display panels extended downwardly from front vent pockets displaying information.

The right front informational display panel 35 is attached at one end to the right front panel 10 at the right front panel seam 30. Display panel 35, when in the first position, extends upwardly into the right front vent pocket 14. Display panel 35 is held in first position by hook and loop connectors 36A, B and 37A, B as shown in FIG. 1. The extended edge of display panel 35 is attached to the inside surface of upper right front panel 20. By disconnecting hook and loop connectors 36A, B and 37A, B, the upwardly extending edge of display panel 35 may be folded and extended downwardly below right front vent pocket 14 into a second position as shown in FIG. 2. While in this second position, any information printed on the exposed surface of display panel 35 is thereby displayed to the general public. By again extending upwardly display panel 35 into right vent pocket 14, the display panel 35 may be returned to its first position and concealed.

Figure 6:
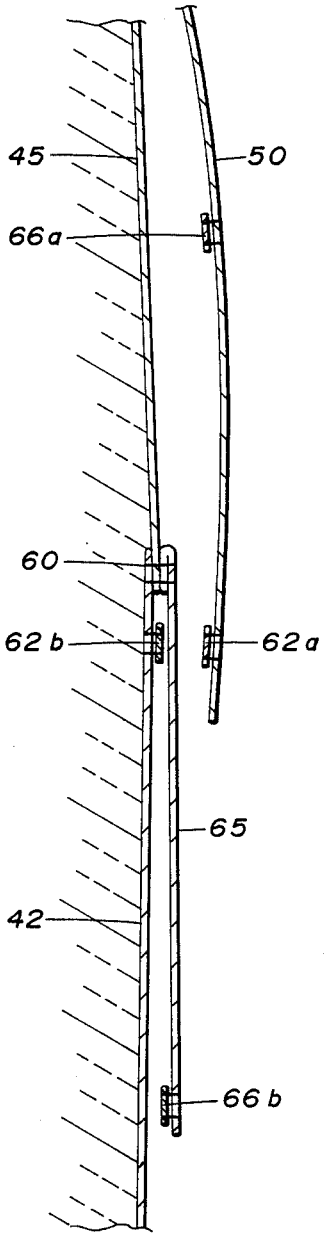
FIG. 6 is a cross-sectional view of the jacket shown in FIG. 2 taken along line 2—2 thereof.

The left front informational display panel 65 operates in a similar fashion. The left front informational display panel 65 is attached at one edge to the left front panel 40 at the left front panel seam 60. Display panel 65 when in first position, extends upwardly into left front vent pocket 47. Display panel 65 is held in the first position by hook and loop connectors 66A, B as shown in FIG. 1 and FIG. 5. The extended edge of display panel 65 is attached to the inside surface of upper left front panel 50. By disconnecting hook and loop connector 66A, B, the extended edge of display panel 65 may be folded extended downwardly below left front vent pocket 47 into a second position as shown in FIG. 2 and 6. While in this second position, any information printed on the exposed surface of display panel 65 is thereby displayed to the general public. By again extending upwardly display panel 65 into left vent pocket 47, the display panel 65 may be returned to its first position and concealed.

Figure 3:
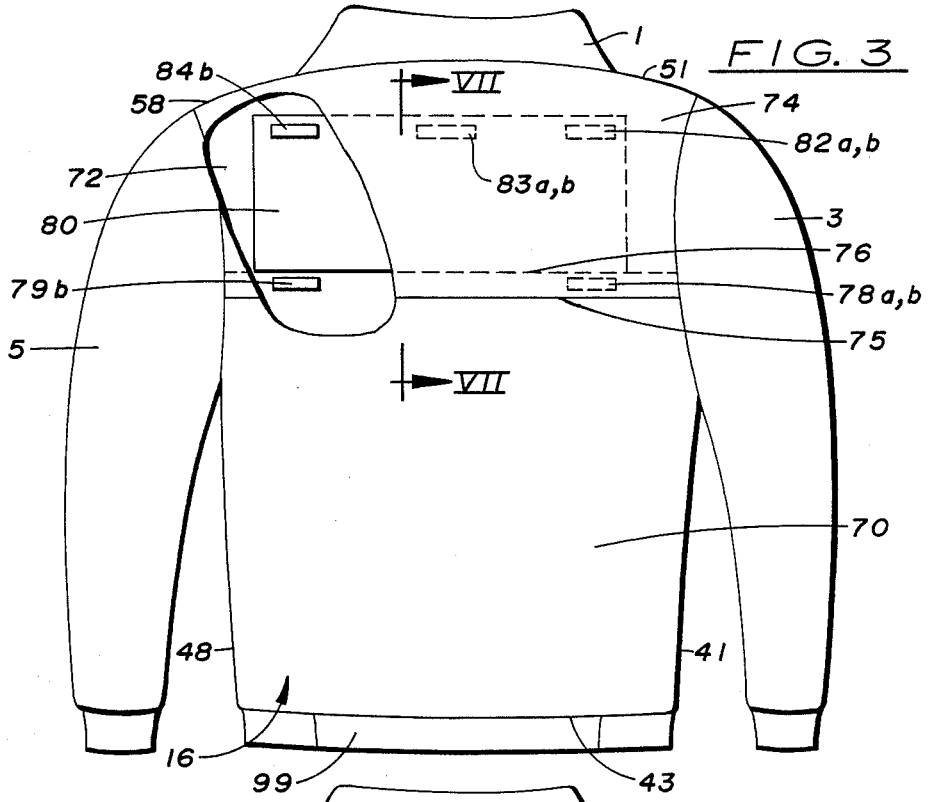
FIG. 3 is a rear view of jacket with a portion broken away with rear informational display panel extended upwardly inside rear vent pocket and concealing information.

As shown in FIG. 3, rear panel 16 consists of a lower rear panel 70 and an upper rear panel 72 interconnected at rear panel seam 76. The rear panel 70 interconnects with front panels 10 and 40 along side seams and attaches to sleeve 3 and sleeve 5. A rear panel seam 76 extends horizontally across the rear panel 16 from points just above the armpits of right sleeve 3 and left sleeve 5. Upper rear panel 72 interconnects with front panels 10 and 40 at shoulder seam and connects to collar 1 and sleeves 3 and 5.

As seen in FIGS. 3 and 4, the rear vent panel 74 stretches across the shoulders and extends downwardly covering the upper rear panel 72 and rear panel seam 76. The upper edge of rear vent panel 74 is attached at the shoulder seams, sleeves 3 and 5, and at the collar 1. Attaching the rear vent panel 74 in the above stated fashion creates an accessible, upwardly extending rear panel pocket 75 as shown in FIG. 3. Rear panel pocket 75 can be opened or closed by hook and loop connectors 78A, B and 79A, B located between lower rear panel 70 and the inside, lower edge of rear vent panel 74, just below rear panel seam 76, as shown in FIG. 7.

Figure 7:
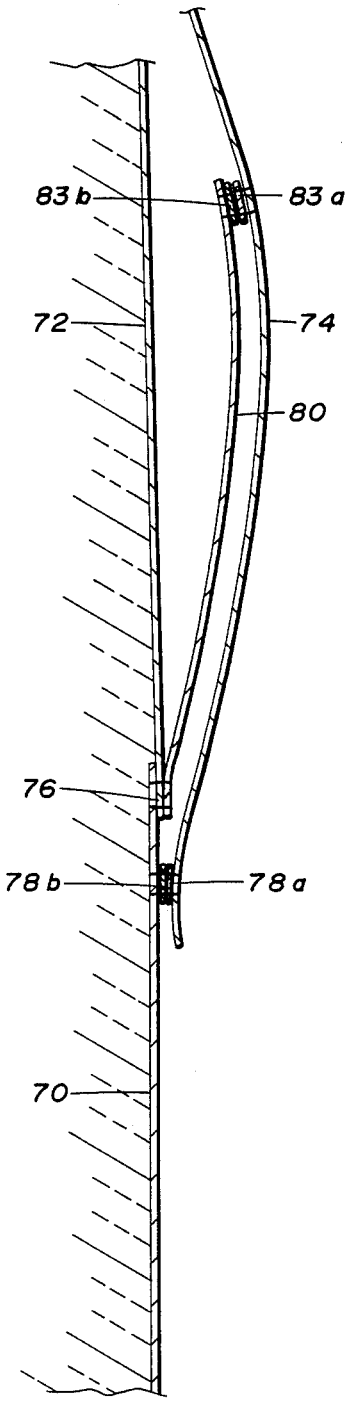
FIG. 7 is a cross-sectional view of the jacket shown in FIG. 3 taken along line 3—3 thereof.
Figure 8:
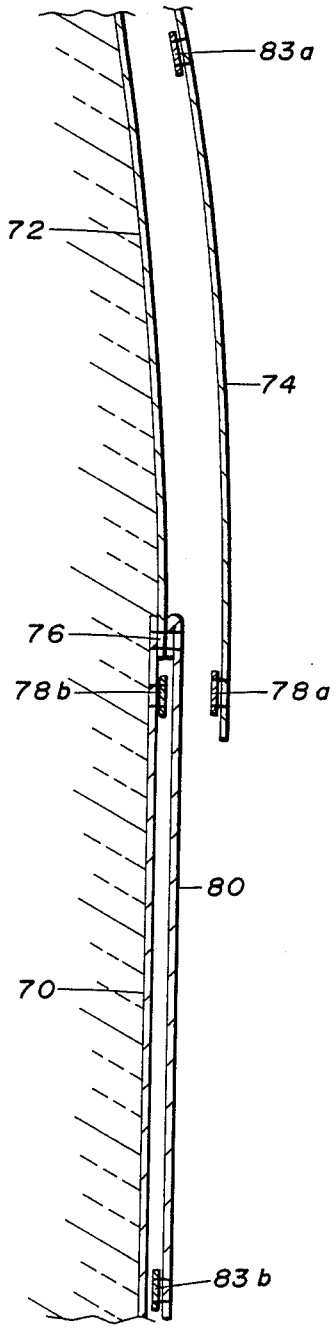
FIG. 8 is a cross-sectional view of the jacket shown in FIG. 4 taken along line 4—4 thereof.

As shown in FIG. 7 the rear informational display panel 80 is attached at one edge to the lower rear panel 70 at rear panel seam 76. Display panel 80 when in first position, extends upwardly into rear vent pocket 75 as shown in FIGS. 3 and 7. Display panel 80 is held in first position by hook and loop connectors 82A, B; 83A, B; and 84A, B, located between the extended edge of display panel 80 and the inside surface of upper rear panel 74. By disconnecting hook and loop connectors 82A, B; 83A, B; and 84A, B, the extended edge of display panel 80 may be folded extended downwardly below rear panel pocket 75 into a second position. While in this second position, information printed on the exposed surface of display panel 80 is displayed to the general public. By again extending display panel 80 upwardly into the rear panel pocket 75, display panel 80 may be returned to its first position and concealed.

As shown in FIG. 1, right pocket 4 is attached to the right front panel 10 and left pocket 9 is attached to left front panel 40. Right inside pocket 6 is attached to the inside surface of right front panel 10 and is designed to hold a radio or walkie-talkie. Left inside pocket 13 designed to hold a large object such as a gun, is attached to inside surface of left front panel 40. Antenna hole 2 is located on the right flang of collar 1.

INDUSTRIAL APPLICABILITY

In the use of the above described jacket, the informational display panels 35, 65, and 80, when in the first position, will be stowed and concealed in vent pockets 14, 47 and 75, respectively. When the situation arises, one or all of the display panels 35, 65 and 80 can be disengaged from their hook and loop connectors and extended downwardly from their vent pockets. When the jacket wearer wants to discontinue or conceal the information again, he must extend upwardly the unattached end of the display panel into the vent pocket. The display panels 35, 65 and 80 are then connected to their respective hook and loop connectors. Each vent panel pockets is then closed by its respective vent panel connectors.

In compliance with the statute, the invention has been described in language more or less specific as to structural features. It is to be understood however, that the invention is not limited by specific features shown, since the means and construction herein disclosed comprise form of putting the invention into effect the invention is disclaimed in any of its forms or modification within the legitimate and valid scope of the amended appendix claims, appropriately interpreted in accordance with the Doctrine of Equivalence.

I claim:

1. A jacket having an attached collar and sleeves, comprising:

(a) a pair of front panels attached to a waistband and to a shoulder seam, each said front panel further comprising an upper front panel, a lower front panel, and a front vent panel, said upper front panel interconnected to said lower front panel along a first front panel seam, said front vent panel having an inside surface and an upper edge attached to said shoulder seam and two said edges attached to said collar and said sleeve and a lower edge which extends over and releasably engages said upper front panel, said front vent panel overlaying said upper front panel, whereby an accessible, upward-extending vent pocket is formed; and (b) a rear panel attached to said waistband and to said pair of front panels at said shoulder seam, said rear panel further comprising an upper rear panel and a lower rear panel and a rear vent panel, said upper rear panel interconnected to said lower rear panel along a rear panel seam, said rear vent panel having an inside surface and an upper edge attached to said shoulder seam, two side seams attached to said sleeves and a detachable lower edge which extends downwardly over said rear panel seam, said rear vent panel overlaying said upper rear panel, whereby an accessible, upward-extending vent pocket is formed; and (c) at least one rectangular informational display means having an attached edge and a detachable edge, said attached edge being attached to said front panel seam; and (d) a hook and loop connector attaching said detachable edge of said informational display means to said inside surface of said front vent panel, whereby said jacket may be easily converted from a conventionally appearing jacket to a jacket with exposed informational display means by detaching said informational display means at said hook and loop connector and extending said informational display means downwardly from said vent pocket.

2. The apparatus of claim 1, further comprising:

(e) a second substantially rectangular informational display means having an attached edge and a detachable edge, said attached edge being attached to a second front panel seam.

3. The apparatus of claim 2, further including:

(f) a hook and loop connector attaching said detachable edge of said second informational display means to said inside surface of said front panel.

* * * * *